US006572437B1

(12) United States Patent
Waitz

(10) Patent No.: US 6,572,437 B1
(45) Date of Patent: Jun. 3, 2003

(54) BRASSIERE

(75) Inventor: Sandra Ann Waitz, Dingmans Ferry, PA (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 09/990,866

(22) Filed: Nov. 16, 2001

(51) Int. Cl.[7] ..... A41C 3/00
(52) U.S. Cl. ..... 450/1; 450/43
(58) Field of Search ..... 450/1.41, 43, 45, 450/46, 51, 52, 53, 65, 66; 2/255, 258

(56) References Cited

U.S. PATENT DOCUMENTS

| | | | | | |
|---|---|---|---|---|---|
| 2,301,499 | A | | 11/1942 | Amyot | |
| D156,901 | S | | 1/1950 | Koslovsky | |
| 2,604,625 | A | * | 7/1952 | Gruber | 450/53 |
| 2,637,041 | A | * | 5/1953 | Bachmann | 450/53 |
| 2,711,536 | A | | 6/1955 | Hartman | |
| 2,915,067 | A | * | 12/1959 | Bracht | 450/53 |
| 3,062,216 | A | | 11/1962 | Stein | |
| 3,066,676 | A | | 12/1962 | Kaupp | |
| 3,154,081 | A | * | 10/1964 | Moody | 450/53 |
| 3,163,167 | A | * | 12/1964 | Chisholm | 450/41 |
| 3,266,495 | A | | 8/1966 | Sachs | |
| 3,372,698 | A | | 3/1968 | Gingras | |
| 4,143,662 | A | * | 3/1979 | Fisher | 450/65 |
| 4,295,469 | A | | 10/1981 | Lindgren | |
| 4,583,544 | A | | 4/1986 | Flanagan et al. | |
| 4,767,377 | A | * | 8/1988 | Falla | 450/41 |
| 4,816,005 | A | | 3/1989 | Braaten | |
| D316,322 | S | | 4/1991 | Bosler et al. | |
| 5,032,104 | A | | 7/1991 | Rainville | |
| 5,037,348 | A | | 8/1991 | Farino | |
| 5,441,436 | A | | 8/1995 | Moretz et al. | |
| 5,660,577 | A | * | 8/1997 | Modena | 450/41 |
| D388,587 | S | | 1/1998 | Magidson et al. | |
| 5,823,851 | A | | 10/1998 | Dicker | |
| 5,873,768 | A | | 2/1999 | Fleischman-Ament et al. | |
| 6,425,799 | B1 | * | 7/2002 | Pai | 450/41 |
| 6,425,800 | B1 | * | 7/2002 | Huang | 450/41 |
| 6,439,959 | B1 | * | 8/2002 | Magrone et al. | 450/41 |

* cited by examiner

*Primary Examiner*—Gloria M. Hale
(74) *Attorney, Agent, or Firm*—Ohlandt, Greeley, Ruggiero & Perle, L.L.P.

(57) ABSTRACT

There is provided a brassiere made of a stretchable material for comfort. Each breast cup has a breast receiving portion with an inner layer and an outer layer, and a support panel portion with the inner and outer layers and a breast supporting panel between the inner and outer layers. The breast supporting panel is substantially inelastic in all directions and, preferably, forms an arcuate edge for supporting the breast. Thus, the entire brassiere stretches and moves with the wearer, while each non-elastic breast supporting panel provides the desired breast support. The bottom edge of the breast supporting panel is spaced from the bottom edge of the brassiere. Decreasing the length of the breast supporting panel so that its bottom edge does not contact the bottom edge of the brassiere allows the bottom periphery of the brassiere to have additional flex that improves the overall comfort of the brassiere. Preferably, the bottom edge of the brassiere is turned to form the waistband of the brassiere.

20 Claims, 3 Drawing Sheets

BRASSIERE

BACKGROUND OF THE INVENTION

1. Field of the Invention

The present invention generally relates to brassiere. More particularly, the present invention relates to brassiere, especially sport brassiere, having breast supporting panels in the breast cups.

2. Description of the Prior Art

A brassiere attempts to combine comfort for the wearer and support for the breasts, which can be mutually exclusive features. Commonly, a brassiere incorporates stretchable or elastic materials for the comfort of the wearer. Typically, support for the breasts is achieved with underwires made of rigid materials, such as metal and/or plastic.

The difficulty in making both a comfortable and supportive brassiere is amplified for "sports"brassiere designed to be worn during exercise and other physical activities. Some sports brassiere function by compressing the breasts to the body of the wearer. A disadvantage of this type of sports brassiere is that it does not support the breasts of the wearer and the breasts may shift within the sports brassiere during exercise and other physical activities. To reduce the risk of injury to the breasts and back, sports brassiere are expected to be strong and fully supportive. At the same time, sports brassiere are sometimes worn for extended periods of time. Therefore, such brassiere must be quite comfortable to wear. Also, for various reasons, some women prefer to wear sports brassiere exclusively, instead of everyday and/or "fashion" brassiere.

In light of the foregoing, there is an ongoing need for brassiere, especially sports brassiere, that are both comfortable to wear and adequately support the breasts of the wearer.

SUMMARY OF THE INVENTION

It is an object of the present invention to provide a brassiere that is comfortable to wear.

It is also an object of the present invention to provide a comfortable brassiere that can adequately support the breasts of a wearer during exercise and other physical activities.

It is a further object of the present invention to provide such a comfortable and supportive brassiere that is simple to manufacture.

In light of the foregoing, there is provided a brassiere having a body made of a stretchable material for comfort. Each breast cup has a breast receiving portion with an inner layer and outer layer, and a support panel portion with the inner and outer layers and a breast supporting panel between the inner and outer layers. The breast supporting panel is substantially inelastic in all directions and, preferably, forms an arcuate edge for supporting the breast. Thus, the entire brassiere stretches and moves with the wearer, while each non-elastic breast supporting panel provides the desired breast support. Significantly, the bottom edge of each breast supporting panel is spaced from the bottom edge of the brassiere. Decreasing the length of the breast supporting panel so that its bottom edge does not contact the bottom edge of the brassiere allows the bottom periphery of the brassiere to have additional flex that improves the overall comfort of the brassiere. Preferably, the bottom edge of the brassiere is turned to form the waistband of the brassiere.

DETAILED DESCRIPTION OF THE INVENTION

Figure 1:
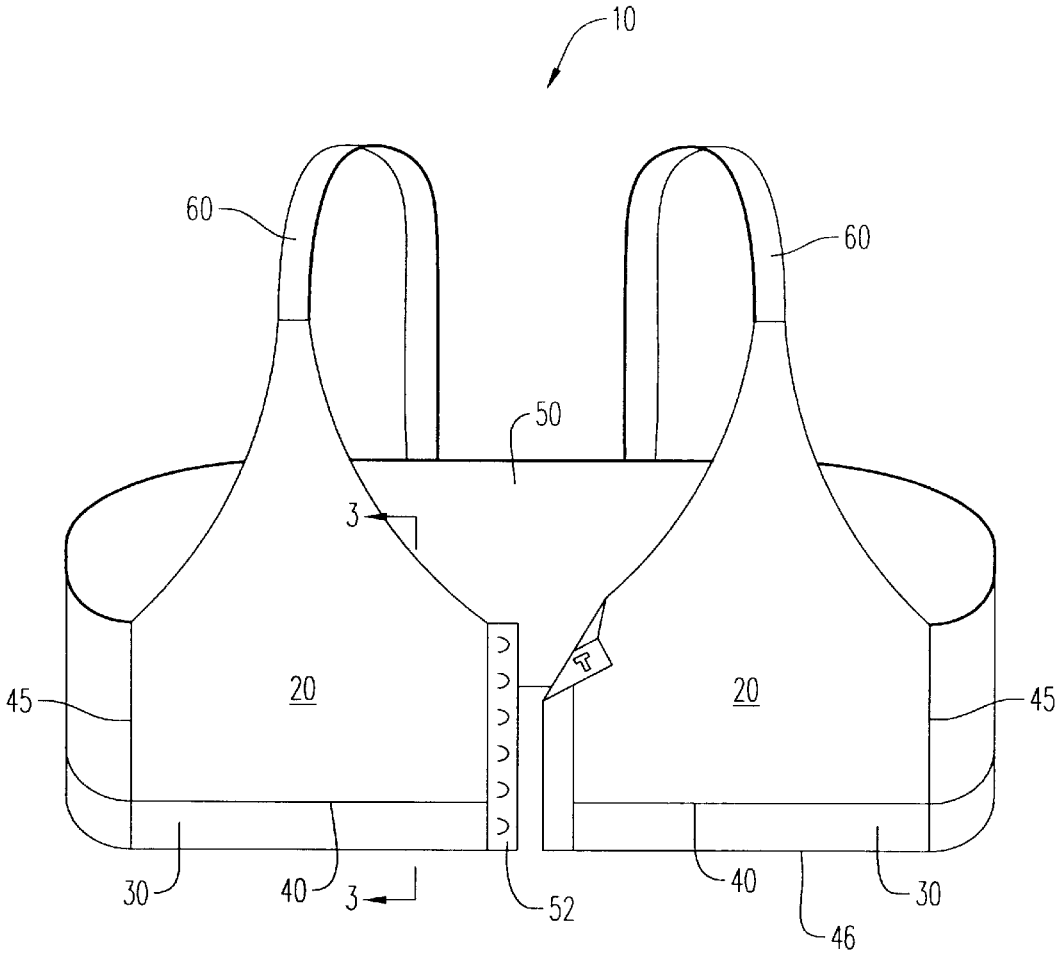
FIG. 1 is a brassiere according to the present invention.

Referring to the drawings and, in particular, FIG. 1, there is provided a brassiere or "brassiere" according to the present invention generally represented as reference numeral 10.

As shown in FIG. 1, brassiere 10 is a sports brassiere having a pair of front panels 20, a back panel 50 that connects the front panels together at one end at a seam line 45, and a pair of shoulder straps 60. As illustrated in FIG. 1, brassiere 10 has shoulder straps 60 that are connected to the top of front panels 20. However, it should be noted that the present invention can be practiced on a strapless brassiere. Brassiere 10 is illustrated with a hook-and-eye closure system 52 between front panels 20, and positioned opposite back panel 50. However, brassiere 10 may be opened and closed at back panel 50. Alternatively, brassiere 10 may be made without a closure system and simply pulled over the torso of the wearer. In addition, closure system 52 may be any closure system known in the art, including, but not limited to, hook-and-eye, hook-and-loop (e.g., "VELCRO®") systems, and/or laces.

Figure 2:
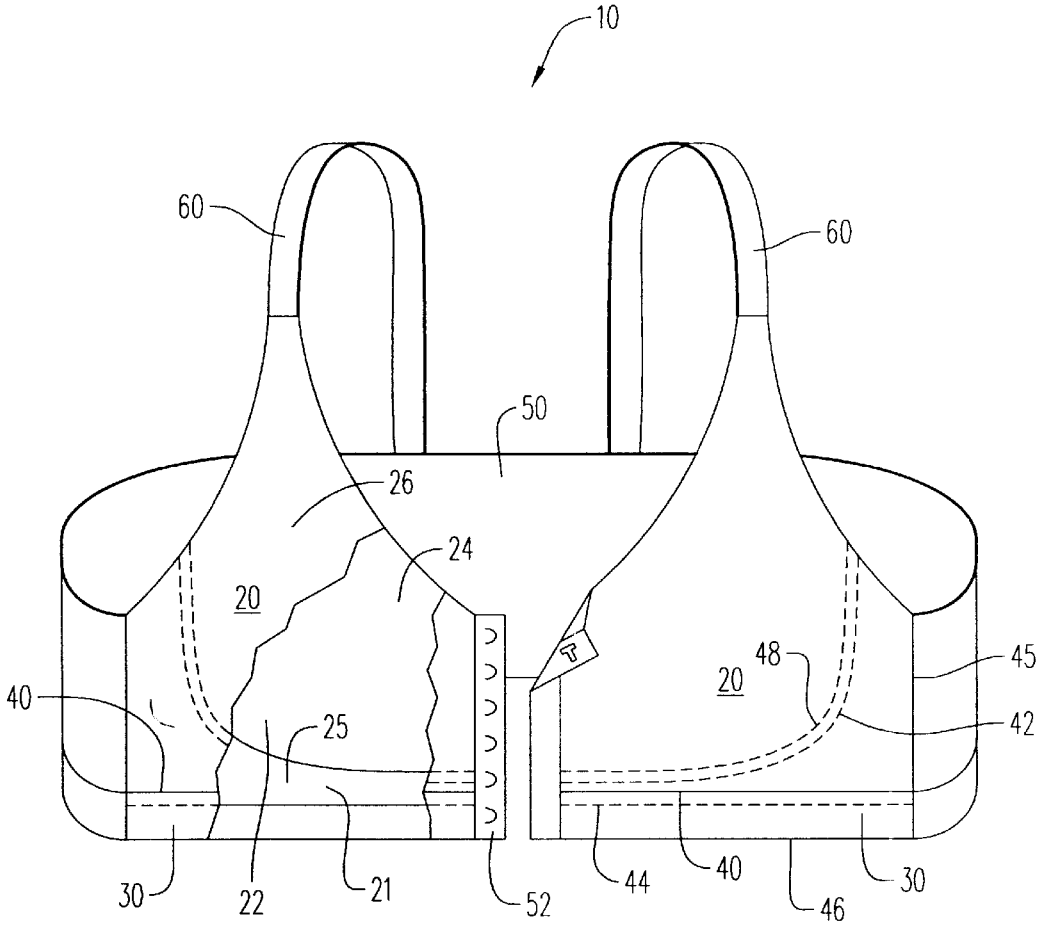
FIG. 2 is a cutaway view of the brassiere of FIG. 1 with the outer fabric layer removed to show the breast supporting panel.

As shown in FIG. 2, each front panel 20 has a breast receiving portion or section 22, a support panel area 21, and a peripheral portion or section 30 with a bottom edge 46. Front panel 20 is completely seam free across the breasts of the wearer to prevent irritation that may occur from the friction between seams and the body of the wearer. Support panel area 21 is demarcated from peripheral section 30 by a seam 40. Seam 40 outlines an upper boundary for peripheral section 30.

Figure 3:
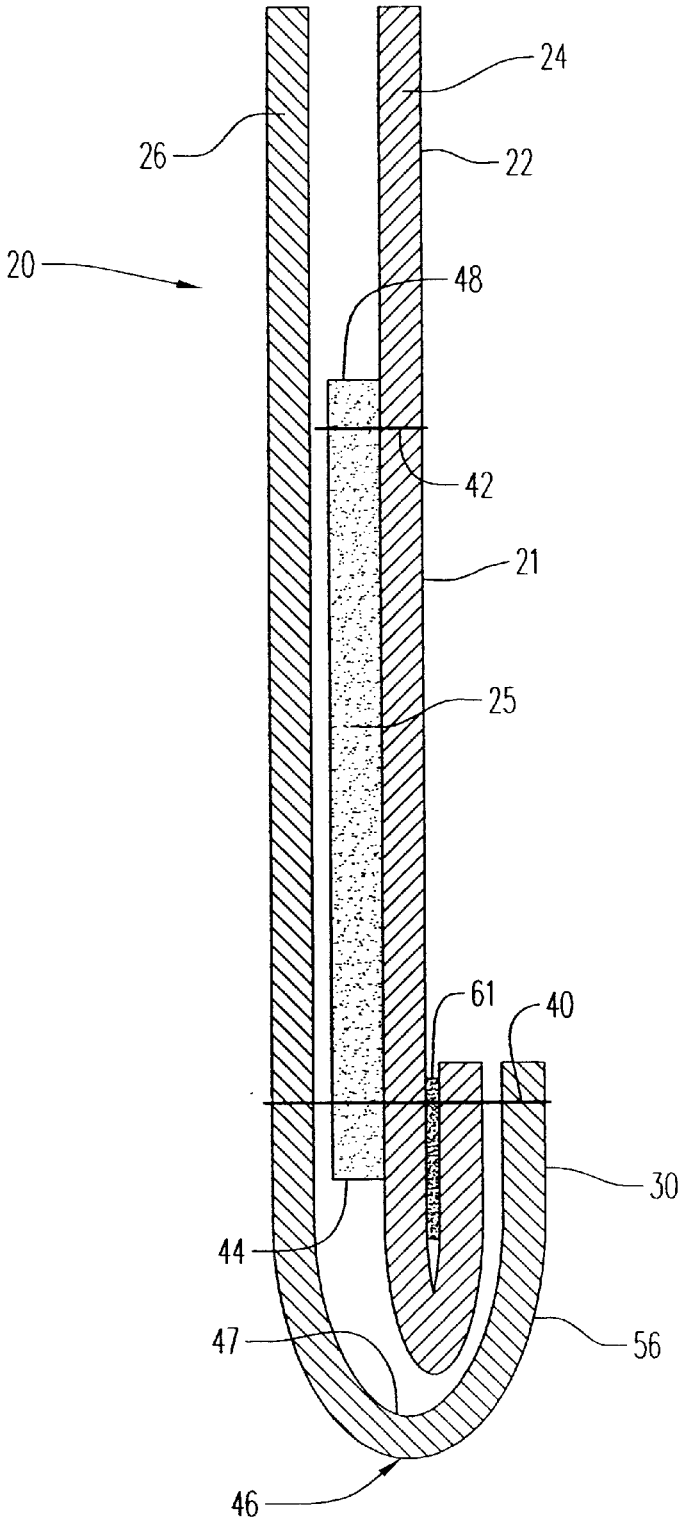
FIG. 3 is a cross-section of the brassiere of FIG. 1 taken along line 3—3.

Referring to FIGS. 2 and 3, each breast receiving portion 22 has an inner fabric layer 24 and an outer fabric layer 26 that are connected together. Each support panel area 21 has inner and outer fabric layers 24 and 26 and a breast supporting panel 25 between the inner and outer layers. As shown in FIG. 3, breast receiving portion 22 and support panel area 21 are integrally joined to form front panel 20. Preferably, as shown in FIG. 3, breast supporting panel 25 is attached to inner fabric layer 24 with a stitched seam 42, so that no stitching is visible on outer fabric layer 26. In addition, breast supporting panel 25 is preferably inserted between fabric layers 24 and 26 only in support panel area 21, however in breast receiving portion 22, inner and outer layers 24 and 26 are secured together so that they remain flat and smooth next to the breast of the wearer.

Breast supporting panel 25 has a bottom edge 44. Bottom edge 44 extends into peripheral portion 30, but does not extend to bottom edge 46 of brassiere 10. Rather, bottom edge 44 falls between bottom edge 46 and seam 40 that starts peripheral section 30. Spacing bottom edge 44 from bottom edge 46 provides for less thickness at bottom edge 46 so that bottom edge 46 can have a folded over portion 56 that forms peripheral section 30 into a waistband for brassiere 10. For example, inner layer 24 and outer layer 26 fold at bottom edge 46 and are stitched together at seam 40 to form a double layer with space in between the layers at peripheral section 30. Also affixed to peripheral section 30 at seam 40 is a continuous elastic band 61, which is surrounded by inner layer 24 and outer layer 26. Preferably, bottom edge 44 is spaced about 1 mm to about 50 mm away from the inside surface 47 of bottom edge 46. More preferably, bottom edge 44 is spaced about 1 mm to about 30 mm away from inside surface 47 of bottom edge 46. This feature also gives additional flexibility to peripheral section 30 so that the brassiere 10 is more comfortable, since brassiere 10 can adjust to the body more readily as the body moves.

The various layers and sections of brassiere 10 may be made with any suitable material. Front panel 20, back panel 50, and inner and outer layers 24, 26 are all made from a stretchable or elastic type material. This stretchable or elastic type material may be made of varying combinations of cotton or polyester or nylon, and spandex. This elastic type material may have from 3% to 25% spandex, and the remainder is nylon or cotton or polyester or any combinations thereof. Breast receiving portion 22 is substantially, and preferably totally elastic, in both the vertical and horizontal directions.

Breast supporting panel 25 is a substantially non-stretch or non-elastic panel. Panel 25 is shaped to provide for extra support to the sides, underarm, bottom and center front of a woman's breast. Preferably, top edge 48 of breast supporting panel 25 above seam 42 forms an arcuate edge for supporting the breast of the wearer. Breast supporting panel 25 is preferably stitched adjacent a top edge 48 to inner fabric layer 24. Top edge 48 preferably has a binding material that covers the raw edge of breast supporting panel 25. The binding material allows for extra strength along top edge 48 and keeps the top edge from rolling or curling.

In a preferred embodiment, inner and outer layers 24 and 26 are preferably at least partially made with an elastic fabric, such as nylon spandex, while breast supporting panel 25 is preferably made with substantially inelastic cotton or nylon yarn.

Peripheral section 30 is formed from the same fabric as inner layer 24 and outer layer 26. Peripheral portion 30 is substantially inelastic in both the vertical and horizontal directions in the region of the front panel 20 from closure 52 to seam line 45 due to breast supporting panel 25 being positioned between inner layer 24 and outer layer 26. Peripheral portion 30 is substantially elastic in both the Vertical and horizontal directions in the region of the back panel 50, e.g. from seam 45 on one side of the brassiere around the torso of the wearer to the same seam 45 on the other side of the brassiere.

Brassiere 10 may be made using any process known in the art. Preferably, the process for forming brassiere 10 results in a minimal number of seams that could irritate the wearer. Outer and inner layers 24 and 26 may, for instance, be formed with a circular knitting machine. Brassiere 10 having circularly knitted inner and outer layers 24 and 26 may be made by sewing breast supporting panel 25 to inner layer 24, placing inner layer 24 over breast supporting panel 25, cutting the resulting brassiere blank to form arm and neck openings, and sewing inner and outer layers 24 and 26 together.

A brassiere 10 made according to the present invention is comfortable to wear and provides support to a wearer's breasts. Moreover, the breast supporting panel 25 helps to keep the breasts more "centered" in brassiere 10 than a traditional compression sports brassiere.

The present invention having been thus described with particular reference to the preferred forms thereof, it will be obvious that various changes and modifications may be made therein without departing from the spirit and scope of the present invention as defined in the appended claims.

What is claimed is:

1. A brassiere comprising:

a pair of front panels, each having stretchable inner and outer layers, each layer having a breast receiving section, a support panel area and a peripheral section, said peripheral section having a top boundary that adjoins said support panel area and a bottom edge; and a substantially inelastic breast supporting panel positioned between said inner and outer layers in said support panel area, said breast supporting panel having an upper edge and a lower edge, said lower edge being below said top boundary and spaced apart from said bottom edge, so that there is less thickness at said bottom edge.

2. The brassiere of claim 1, further comprising a back panel connected to said pair of front panels.

3. The brassiere of claim 1, further comprising a pair of shoulder straps, each shoulder strap being connected to one of said pair of front panels and said back panel.

4. The brassiere of claim 1, wherein each of said pair of front panel is seamless.

5. The brassiere of claim 1, wherein said breast receiving section forms a breast cup.

6. The brassiere of claim 1, wherein said peripheral section is adapted to extend around the torso of a wearer.

7. The brassiere of claim 1, wherein said inner and outer layers are each made with a material selected from the group consisting of nylon, spandex, and any combination thereof.

8. The brassiere of claim 1, wherein said peripheral section is formed from a material selected from the group consisting of nylon, spandex, and any combination thereof.

9. The brassiere of claim 1, wherein said peripheral section has an elastic band connected thereto.

10. The brassiere of claim 9, wherein one of said inner and outer layers is folded about said elastic band at said bottom edge and said elastic band is connected to one of said inner and outer layers.

11. The brassiere of claim 9, wherein said peripheral portion is substantially inelastic in both the vertical and horizontal directions in the region of said front panel.

12. The brassiere of claim 9, wherein said peripheral portion is substantially elastic in both the vertical and horizontal directions in the region of a back panel.

13. The brassiere of claim 1, wherein said breast supporting panel is connected to at least one of said inner and outer layers.

14. The brassiere of claim 1, wherein said breast supporting panel is made of a non-stretchable material.

15. The brassiere of claim 1, wherein said breast supporting panel is made with a material selected from the group consisting of cotton, nylon, and any combinations thereof.

16. The brassiere of claim 1, wherein said breast supporting panel is spaced apart from said free bottom edge to increase flexibility of said peripheral portion.

17. The brassiere of claim 1, wherein said lower edge of said breast supporting panel is spaced apart from said free bottom edge about 1 mm to about 50 mm.

18. The brassiere of claim 1, wherein said lower edge of said breast supporting panel is spaced apart from said free bottom edge about 1 mm to about 30 mm.

19. A brassiere comprising:

a front panel having at least two stretchable layers, each layer having a breast receiving section, a support panel area and a peripheral section, said peripheral section having a top boundary that adjoins said breast receiving section and a bottom edge, and an elastic band connected to one of said stretchable layers, said elastic band being surrounded by one of said stretchable layers; and a substantially inelastic breast supporting panel positioned between said at least two stretchable layers in said support panel area, said breast supporting panel having an upper edge and a lower edge, said lower edge being below said top boundary and spaced apart from said free bottom edge, whereby said breast supporting panel provides for less thickness at said free bottom edge.

20. The brassiere of claim 19, wherein said stretchable layers are adapted to fold at said bottom edge.

* * * * *